US007517391B2

(12) United States Patent
Hall et al.

(10) Patent No.: US 7,517,391 B2
(45) Date of Patent: Apr. 14, 2009

(54) METHOD OF BULK TRANSPORT AND STORAGE OF GAS IN A LIQUID MEDIUM

(75) Inventors: Bruce Hall, Katy, TX (US); Micahel J. Mulvany, Houston, TX (US); Tolulope O. Okikiolu, Houston, TX (US)

(73) Assignee: SeaOne Maritime Corp., Houston, TX (US)

( * ) Notice: Subject to any disclaimer, the term of this patent is extended or adjusted under 35 U.S.C. 154(b) by 330 days.

(21) Appl. No.: 11/483,137

(22) Filed: Jul. 7, 2006

(65) Prior Publication Data

US 2007/0017575 A1 Jan. 25, 2007

Related U.S. Application Data

(60) Provisional application No. 60/697,810, filed on Jul. 8, 2005.

(51) Int. Cl.
*F17C 7/04* (2006.01)
*F25J 1/00* (2006.01)
*B63B 25/08* (2006.01)

(52) U.S. Cl. ..... 95/231; 96/155; 62/46.1; 62/611; 114/74 R

(58) Field of Classification Search ..... 96/108, 96/155; 95/231, 241; 62/46.1, 48.1, 611, 62/618; 114/74 R; 206/0.7; 220/560.04
See application file for complete search history.

(56) References Cited

U.S. PATENT DOCUMENTS

| | | | |
|---|---|---|---|
| 2,497,793 | A | 2/1950 | Ransome |
| 2,550,844 | A | 5/1951 | Meiller et al. |
| 3,232,725 | A | 2/1966 | Secord et al. |
| 3,256,709 | A | 6/1966 | Stepleton |
| 3,298,805 | A | 1/1967 | Secord et al. |
| 3,407,613 | A | 10/1968 | Muller et al. |
| 3,548,024 | A | 12/1970 | Kniel |
| 4,010,622 | A | 3/1977 | Etter |
| 4,024,720 | A | 5/1977 | Dimentsberg et al. |
| 4,139,019 | A | 2/1979 | Bresie et al. |
| 4,203,742 | A | 5/1980 | Agnihotri |
| 4,479,350 | A | 10/1984 | Newton et al. |

(Continued)

FOREIGN PATENT DOCUMENTS

| | | |
|---|---|---|
| GB | 1415729 | 11/1975 |

OTHER PUBLICATIONS

Charles White et al., "*The Impact of Compressed Natural Gas Shipping Upon Offshore Gas Development*", 2003 Offshore Technology Conference (May 5-8, 2003), #OTC 15070, pp. 1-9.

(Continued)

*Primary Examiner*—Frank M Lawrence
(74) *Attorney, Agent, or Firm*—Orrick, Herrington & Sutcliffe LLP

(57) ABSTRACT

An integrated ship mounted system for loading a gas stream, separating heavier hydrocarbons, compressing the gas, cooling the gas, mixing the gas with a desiccant, blending it with a liquid carrier or solvent, and then cooling the mix to processing, storage and transportation conditions. After transporting the product to its destination, a hydrocarbon processing train and liquid displacement method is provided to unload the liquid from the pipeline and storage system, separate the liquid carrier, and transfer the gas stream to a storage or transmission system.

21 Claims, 6 Drawing Sheets

U.S. PATENT DOCUMENTS

| | | | | |
|---|---|---|---|---|
| 4,622,053 | A | 11/1986 | Tomlinson et al. | |
| 5,201,918 | A * | 4/1993 | Vobach | 95/173 |
| 5,315,054 | A | 5/1994 | Teel | |
| 6,023,942 | A | 2/2000 | Thomas et al. | |
| 6,112,528 | A | 9/2000 | Rigby | |
| 6,174,440 | B1 | 1/2001 | Charron et al. | |
| 6,201,163 | B1 | 3/2001 | Morris et al. | |
| 6,217,626 | B1 | 4/2001 | Morris et al. | |
| 6,260,501 | B1 | 7/2001 | Agnew | |
| 6,339,996 | B1 | 1/2002 | Campbell | |
| 6,449,961 | B1 | 9/2002 | Korsgaard | |
| 6,584,780 | B2 | 7/2003 | Hibino et al. | |
| 6,584,781 | B2 | 7/2003 | Bishop et al. | |
| 6,613,126 | B2 | 9/2003 | Tange et al. | |
| 6,655,155 | B2 | 12/2003 | Bishop | |
| 6,699,308 | B1 | 3/2004 | Nilsen et al. | |
| 6,725,671 | B2 | 4/2004 | Bishop | |
| 6,729,492 | B2 | 5/2004 | Gulati | |
| 2006/0042273 | A1 * | 3/2006 | Morris et al. | 62/46.1 |
| 2006/0042692 | A1 * | 3/2006 | Agnew et al. | 137/263 |

OTHER PUBLICATIONS

Mark Richards and Charles White, Powerpoint Presentation and accompanying paper entitled "*Design and Development of Ocean CNG Transport Systems*", Natural Gas Technologies II presented Feb. 11, 2004 (.

* cited by examiner

BACK
AFT
FRONT
FORE

300
CONSOLIDATED GAS LIQUID - LOADING
REGASIFICATION SIDE - OFFLOADING
100
VESSEL
10
VESSEL
10
FRONT
FORE
BACK
AFT

METHOD OF BULK TRANSPORT AND STORAGE OF GAS IN A LIQUID MEDIUM

CROSS REFERENCE TO RELATED APPLICATIONS

This application claims the benefit of U.S. Provisional Application No. 60/697,810, filed Jul. 8, 2005, which is incorporated herein been reference.

FIELD OF THE INVENTION

The invention relates generally to storage and transportation of produced or natural gas or other gases, and specifically to the bulk handling of natural gas, vapor phase hydrocarbons, or other gases in a liquid medium; and to its segregation into a gaseous phase for delivery into storage or into gas transmission pipelines. As described herein, the present invention is particularly applicable to ship or barge installation for marine transportation and to on board gas processing, but is equally applicable to ground modes of transportation such as rail, trucking and land storage systems for natural gas.

BACKGROUND OF THE INVENTION

Natural gas is predominantly transported and handled by pipeline as a gaseous medium or in the form of Liquid Natural Gas (LNG) in ships or peak shaving facilities. Many gas reserves are remotely located with respect to markets, and of a size smaller than the levels of recoverable product deemed economically worthwhile moving to market by pipeline or Liquefied Natural Gas (LNG) ships.

The slow commercialization of Compressed Natural Gas (CNG) shipping offering volumetric containment of natural gas up to half of the 600 to 1 ratio offered by LNG has shown the need for a method which is complimentary to both these aforementioned systems. The method described herein is intended to fulfill the existing need between these two systems.

The energy intensity of LNG systems typically requires 10 to 14% of the energy content of produced gas by the time the product is delivered to market hubs. CNG has even higher energy requirements associated with gas conditioning, heat of compression of the gas, its cooling and subsequent evacuation from transport containers. As outlined in U.S. patent application Ser. No. 10/928,757 ("the '757 application), filed Aug. 26, 2004, which is incorporated by reference, the handling of natural gas in a liquefied matrix as a liquid medium (referred to as Compressed Gas Liquid™ (CGL™) gas mixture) without resorting to cryogenic conditions has its advantages in this niche market. Both in the compression of gas to a liquid phase for storage conditions, and in the 100% displacement of CGL™ gas mixture during offloading from transportation systems, there are distinct energy demand advantages in the CGL™ process.

The CGL™ process energy demand to meet storage conditions of 1400 psig at −40° F. is a moderate requirement. The higher pressures necessary for effective values of CNG (1800 psig to 3600 psig) at 60° F. down to −20° F., and the substantially lower cryogenic temperatures for LNG (−260° F.) give rise to the greater energy demands for the CNG and LNG processes.

Thus it is desirable to provide systems and methods that facilitate the storage and transport of natural or produced gas with lower energy demands.

SUMMARY

The present invention is directed to a means mounted on marine transport vessel, such as a ship or barge, for loading a production gas stream, separating heavier hydrocarbons, compressing the gas, cooling the gas, drying the gas with a liquid or solid desiccant, blending the gas with a liquid carrier or solvent, and then cooling the mix to processing, storage and transportation conditions. After transporting the product to its destination, a hydrocarbon processing train and liquid displacement method is provided to unload the liquid from the pipeline and storage system, separate the liquid carrier, and transfer the gas stream to the custody of typically a shore storage or transmission system.

In a preferred embodiment, a self contained ship or barge includes a processing, storage and transportation system that converts natural gas, or vapor phase hydrocarbons into a liquefied medium using a liquid solvent mixture of Ethane, Propane, and Butane, the composition and volume of which is specifically determined according to the service conditions and limits of efficiency of the particular solvent, as indicated in the '757 application. The process train is also devised to unload the natural gas product or vapor phase hydrocarbon from the ship mounted pipeline system, segregating and storing the liquid solvent for reuse with the next shipment.

The method described herein is not limited to ship installation and is suited to other forms of transportation with or without the process train installed on the transport medium. The application is particularly suitable for the retrofit of existing tankers or for use with newly built ships.

The loading sequence preferably begins with a natural or production gas flowing from a subsea wellhead, FPSO, offshore platform or shore based pipeline through a loading pipeline connected directly or indirectly to the ship through a buoy or mooring dock. The gas flows through a manifold to a two or three phase gas separator to remove free water and heavy hydrocarbons from the gas stream.

The process train conditions the gas stream for removal of any undesirable components as well as heavy hydrocarbons in a scrubber. The gas is then compressed, cooled and scrubbed to near storage pressure—preferably to about 1100 psig to 1400 psig. The gas is then dried using a liquid or solid desiccant, e.g., a methanol-water mixture or molecular sieve, for hydrate inhibition and then is mixed with a solvent before entering a mixing chamber. The resulting liquid solvent-gas mixture stream is then cooled through a refrigeration system to storage temperature of about −40° F.

The dehydration of the gas is carried out to prevent the formation of gas hydrates. Upon exiting the gas chillers, the hydrocarbon and aqueous solution is separated to remove the aqueous phase components and the now dry liquid solvent-gas mixture stream is loaded into a storage pipe system at storage conditions.

The stored product is kept in banks of bundled pipes, interconnected via manifolds in such a manner that the contents of each bank can be selectively isolated or re-circulated through a looped pipe system which in turn is connected to a refrigeration system in order to maintain the storage temperature continuously during the transit period.

The offloading sequence involves displacement of the contents of the pipe system by a methanol-water mixture. The stored liquid solvent-gas mixture's pressure is reduced to the region of about 400 psig prior to its entry, as a two phase hydrocarbon stream, to a de-ethanizer tower. A mixture composed predominately of methane and ethane gas emerges from the top of the tower to be compressed and cooled to transmission pipeline specification pressure and temperature in the offloading line. From the base of the de-ethanizer tower flows a stream composed predominately of propane and heavier components that is fed to a de-propanizer tower.

From the top of this vessel, a propane stream is fed back into storage ready for the next gas shipment, while from the bottom of the tower a butane rich stream is pumped back into the methane/ethane stream flowing in the offloading line to bring the gas heating value back to par with that of the originally loaded production stream. This process also has the ability to adjust the BTU value of the sales gas stream to meet the BTU value requirements of the customer.

Other systems, methods, features and advantages of the invention will be or will become apparent to one with skill in the art upon examination of the following figures and detailed description.

BRIEF DESCRIPTION OF THE FIGURES

The details of the invention, including fabrication, structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

DESCRIPTION OF THE PREFERRED EMBODIMENT

The details of the present invention are described below in conjunction with the accompanying figures, which are schematic only and not to scale. For exemplary purposes only, the following description focuses on ship or marine use. However, one of ordinary skill in the art will readily recognize that the present invention is not constrained as described here to ship use and for marine transport, but is equally applicable to ground modes such as rail, trucking and land storage systems for natural gas.

In preferred embodiments, storage pressures are set at levels below 2150 psig and temperatures set as low as −80° F. At these preferred pressures and temperature, the effective storage densities for natural or produced gas within a liquid matrix advantageously exceed those of CNG. For reduced energy demand, the preferred storage pressure and temperature are preferably in a range of about 1400 psig and preferably in a range of about −40° F.

Figure 4A:
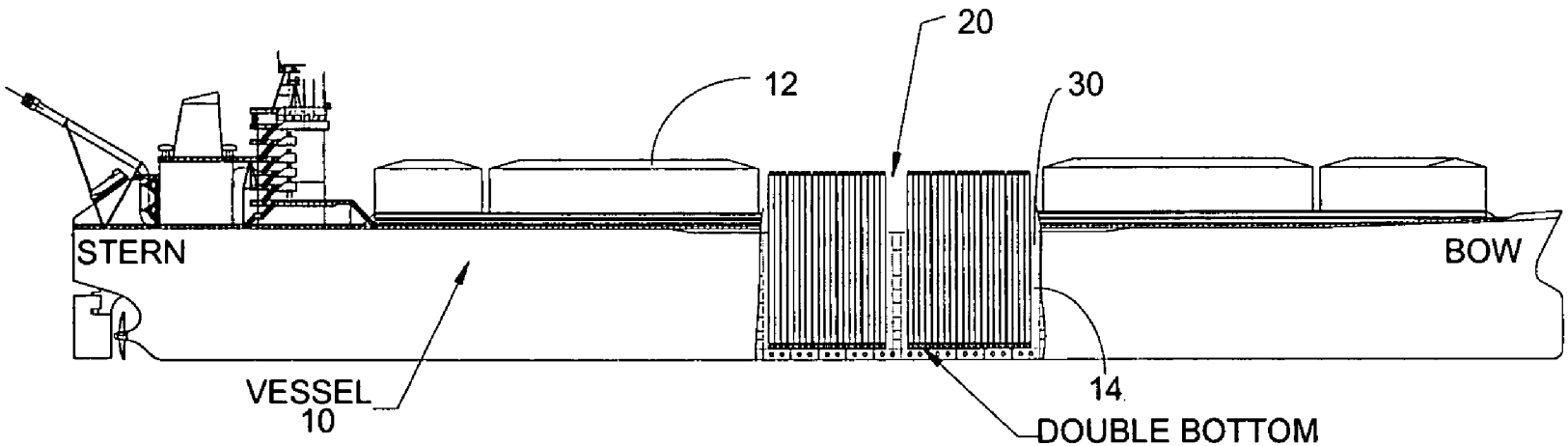
FIG. 4A is a side view of a tanker equipped with an integrated system of the present invention.
Figures 4B, 4C:
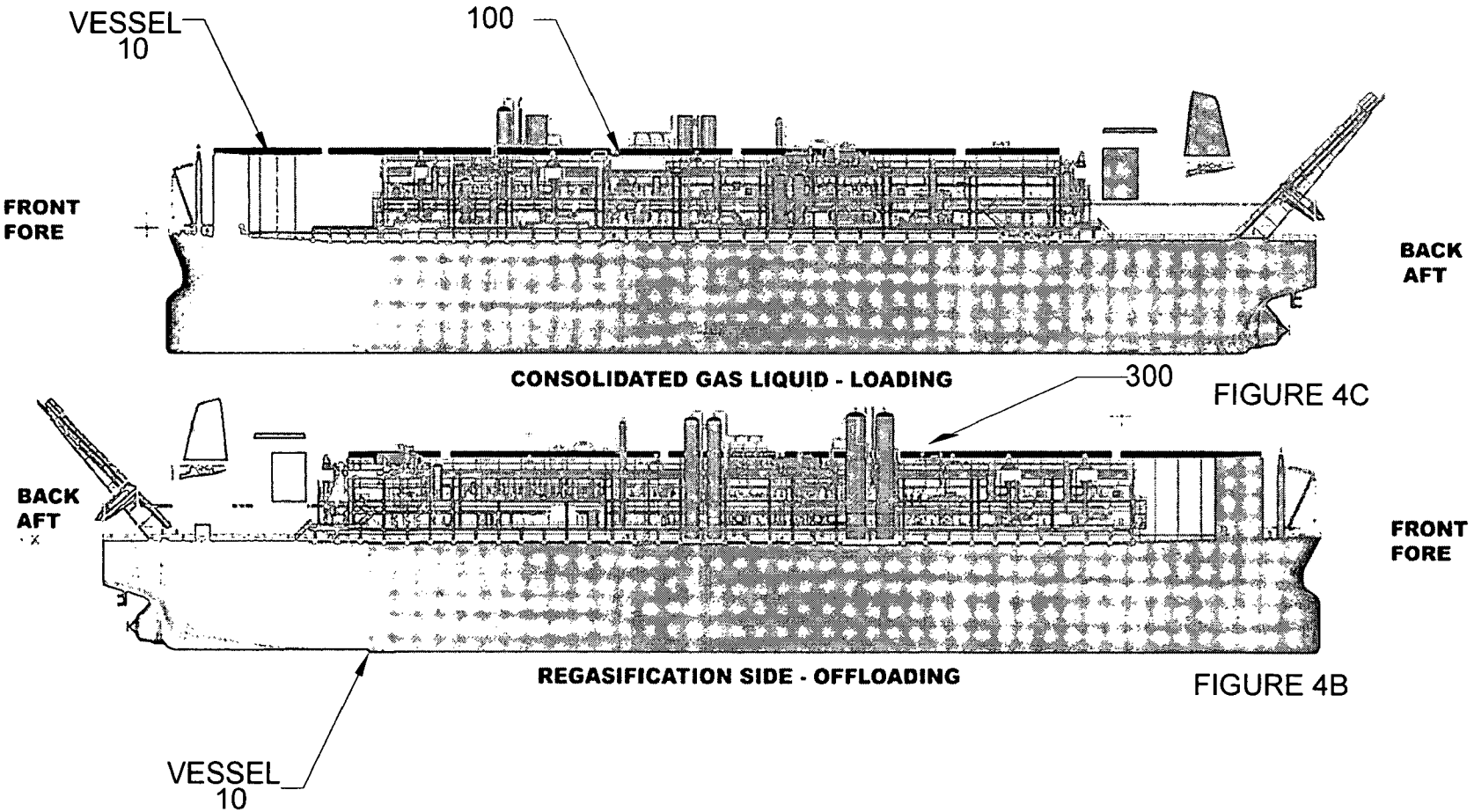
FIGS. 4B and 4C are side views of the tanker showing the loading and unloading systems mounted on the deck.

As depicted in FIG. 4A, a looped pipeline system 20, which is located in the cargo compartments 30 of a tanker 10, is used to contain the transported liquefied production or natural gas mixture. The pipeline system 20 is contained within an insulated cargo hold 30 of the ship or tanker 10. The cargo hold 30 is covered with an insulated hood 12 holding a chilled inert atmosphere 14 that surrounds the pipeline system 20. In a preferred embodiment, as depicted in FIGS. 4B and 4C, the loading process equipment 100 and the separation, fractionation and unloading process equipment 300 are mounted on the side deck of the tanker 10 to provide an integrated system.

Figure 5A:
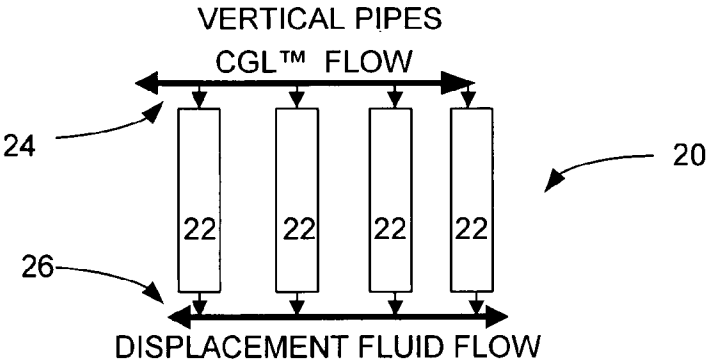
FIG. 5A is a schematic showing vertically disposed pipe banks.

The pipeline system 20, as depicted in FIG. 5A, is designed with vertically oriented pipes or pipe banks 22 that are designed to be serviced from the top 24 or the bottom 26 side of the pipes 22. The pipes 22, which can be skirt or skirtless, preferably include topside 24 or bottom side 26 mounted hardware for maximized use of space in vertical placement. The containment pipes 22 of the pipeline system 20 also preferably include vent and fitting free bases to minimize corrosion and inspection needs in tightly packed cargo holds.

Introduction and extraction of a gas mixture is preferably via a cap mounted pipe connection for the upper level of the pipes 22, and a cap mounted dip tube (stinger) pipe reaching near the bottom of the pipes 22 to service the lower level of the pipe section. This is done so that fluid displacement activity in the pipe preferably has the higher density product introduced from the lower level and lighter density product removed from the upper level. The vertical dip tube is preferably utilized for the filling, displacement and circulation processes.

Figure 5C:
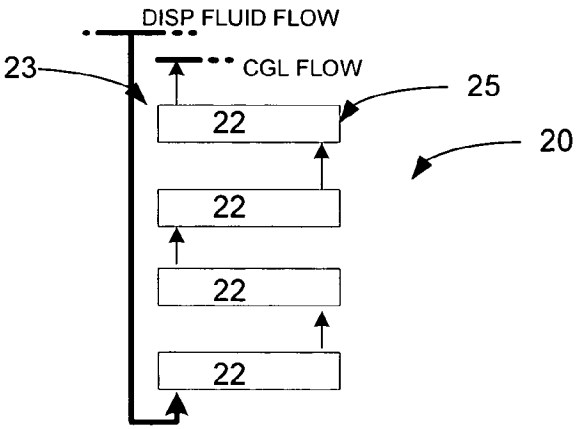
FIG. 5C is another schematic showing horizontally disposed pipe banks.
Figure 5B:
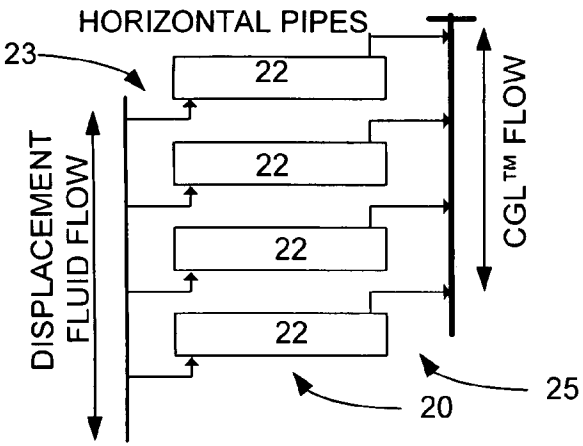
FIG. 5B is a schematic showing horizontally disposed pipe banks.

Turning to FIGS. 5B and 5C, alternative pipeline systems 20 are provided where the pipes or pipe banks 22 are oriented horizontally. As depicted in FIG. 5B, the fluids and gases flow in a first end 23 and out a second 25. In the embodiment depicted in FIG. 5C, the fluids and gases flow in a serpentine fashion through the pipes or pipe banks 22 alternating entering and exiting between first and second ends 23 and 25.

Figure 1:
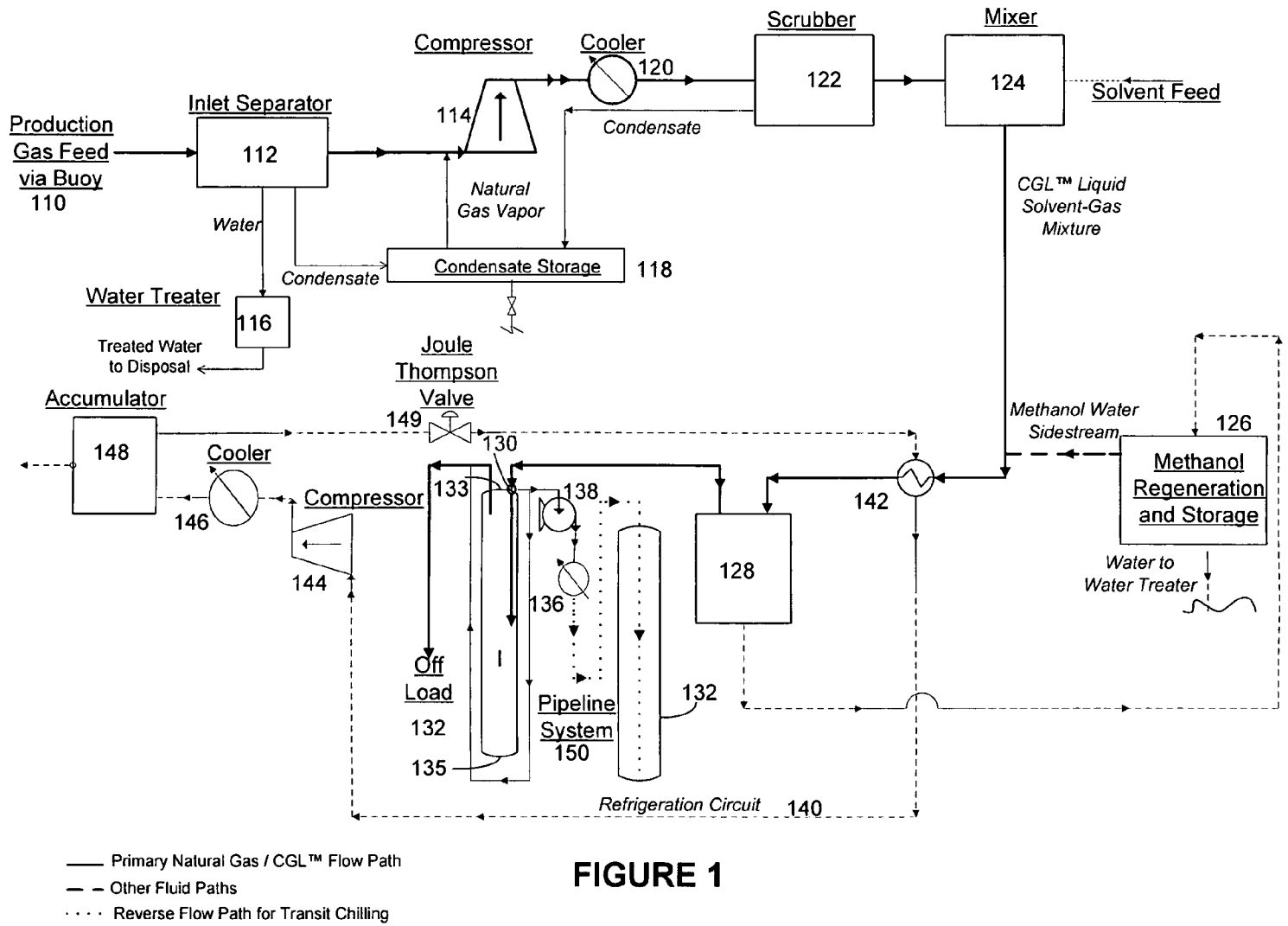
FIG. 1 is a process diagram that depicts the loading process of the present invention.

Referring to FIG. 1, the loading process 100 of the present invention is depicted. The field production stream is collected through a pipeline via a loading buoy 110 about which the ship is tethered. This buoy 110 is connected to the moored ship by hawsers to which are attached flexible pipelines. The gas stream flows to a deck mounted inlet separator 112, whereby produced water and heavy hydrocarbons are separated and sent to different locations. The bulk gas flows to a compressor system 114, if needed. Produced water flows from the separator 112 to a produced water treating unit 116, which cleans the water to the required environmental standards. The condensate flows from the separator 112 to the compressed gas stream. It is possible to store the condensate separately in storage tanks 118 or is re-injected into the compressed gas system.

The compressor system 114 (if required) raises the pressure of the gas to storage condition requirements, which are preferably about 1400 psig and −40° F. The compressed gas is cooled in cooler 120 and scrubbed in scrubber 122, and then sent to a mixing chamber 124. Condensate fallout from the scrubber 122 is directed to the condensate storage 118.

In the mixing chamber 124 the gas stream is combined with metered volumes of a natural gas based liquid (NGL) solvent in accordance with the parameters set forth in the '757 application, resulting in a gas-liquid solvent mixture referred to herein as a Compressed Gas Liquid™ (CGL™) gas mixture. In accordance with preferred storage parameters, the CGL™ gas mixture is stored at pressures in a range between about 1100 psig to about 2150 psig, and at temperatures preferably in a range between about −20° F. to about −180° F., and more preferably in a range between about −40° F. to about −80° F. In forming the CGL™ gas mixture, produced or natural gas is combined with the liquid solvent, preferably liquid ethane, propane or butane, or combinations thereof, at the following concentrations by weight: ethane preferably at approximately 25% mol and preferably in the range between about 15% mol to about 30% mol; propane preferably at approximately 20% mol and preferably in a range between about 15% mol to about 25% mol; or butane preferably at approximately 15% mol and preferably in a range between about 10% mol to about 30% mol; or a combination of ethane, propane and/or butane, or propane and butane in a range between about 10% mol to about 30% mol.

Prior to chilling, the CGL™ gas mixture is preferably dehydrated with a methanol-water or solid desiccant (e.g., molecular sieve) to prevent hydrates from forming in the pipeline system 130. The NGL solvent additive provides the environment for greater effective density of the gas in storage and the desiccant process provides for storage product dehydration control.

The now dry gas/solvent/methanol mix is then passed through a chiller 142 that is part of a refrigeration system 140, which comprises a compressor 144, a cooler 146, an accumulator 148 and a Joule Thompson valve 149, and emerges as a one or two phase liquid stream. This stream then flows through a separator 128 to remove the aqueous phase from the hydrocarbon phase. The aqueous phase is returned to the methanol regeneration and storage system 126. The hydrocarbon phase flows to the main header 130 and on to sub-headers which feed the manifolds located atop vertical bundles of storage pipes 132. To store the CGL™ gas mixture, it is preferably introduced into a pressurized storage pipe or vessel bundle(s) 132 that preferably contain a methanol—water mixture to prevent vaporization of the CGL™ gas mixture.

Introduction of the CGL™ gas mixture into a pipe or vessel bundle section 132 is done preferably by means of a vertical stinger, vertical inlet or outlet line running from the sub-header connection to the manifold atop the cap 133 of the pipe 132 to the base 135 of the pipe 132. The pipe 132 fills, displacing a pressure controlled methanol—water mixture within the pipe 132, until a level control device mounted in the manifold detects the CGL™ gas mixture and causes inlet valve closure. When the inlet valve closes, the flow of the CGL™ gas mixture is diverted to fill the next bundle of pipes or vessels into which the methanol—water has been shuttled.

During the transit part of the cycle, the CGL™ gas mixture tends to gain some heat and its temperature rises slightly as a result. When the higher temperatures are sensed by temperature sensing devices on the top manifolds, the pipeline bundles routinely have their contents circulated via a recirculation pump 138 from the top mounted outlets through a small recirculation refrigeration unit 136, which maintains the low temperature of the CGL™ gas mixture. Once the temperature of the CGL™ gas mixture reaches a preferred pipeline temperature, the cooled CGL™ gas mixture is circulated to other pipeline bundles and displaces the warmer CGL™ gas mixture within those bundles.

Figure 2:
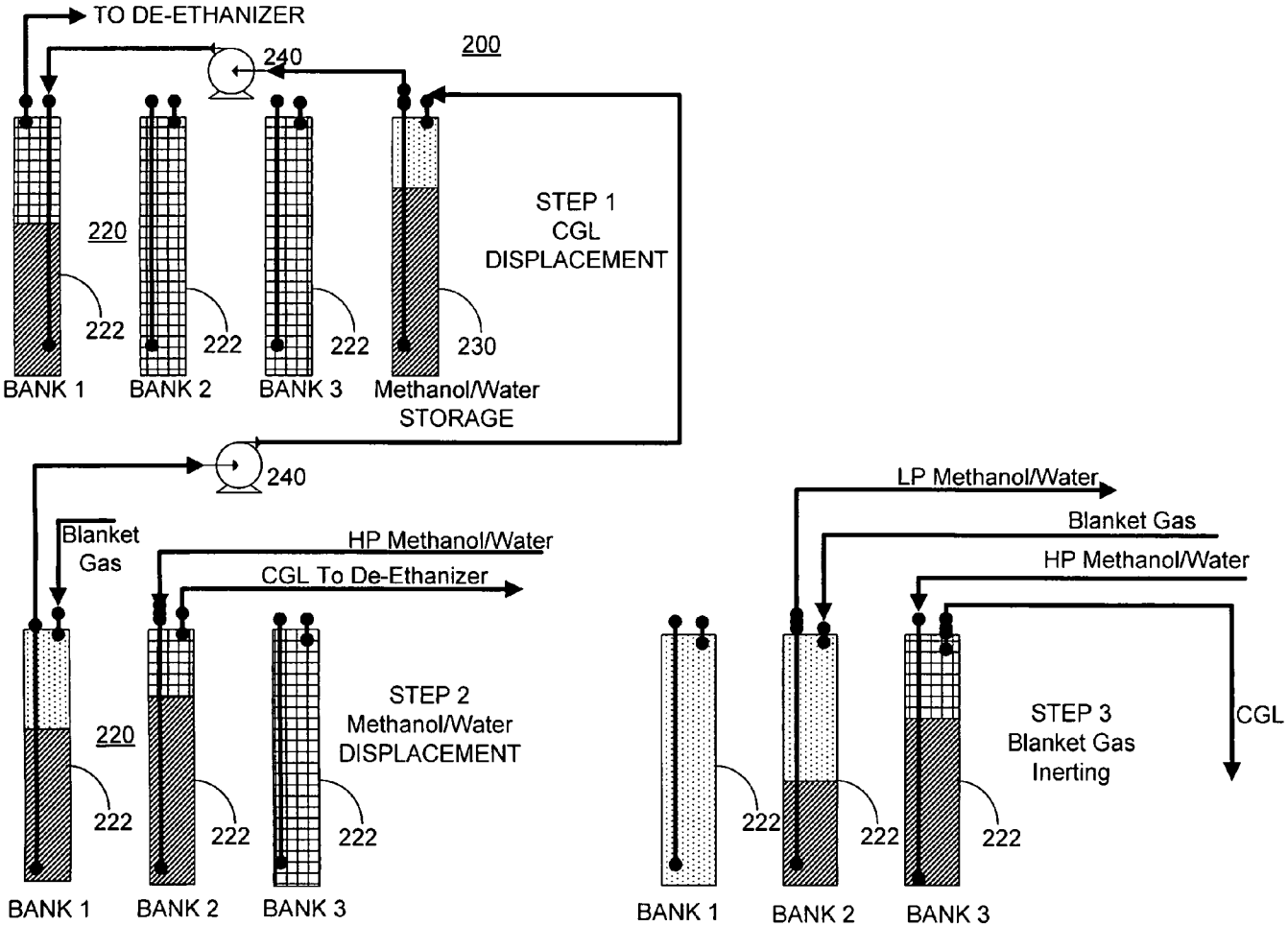
FIG. 2 is a process diagram that depicts the displacement process between successive pipe banks.
Figure 3:
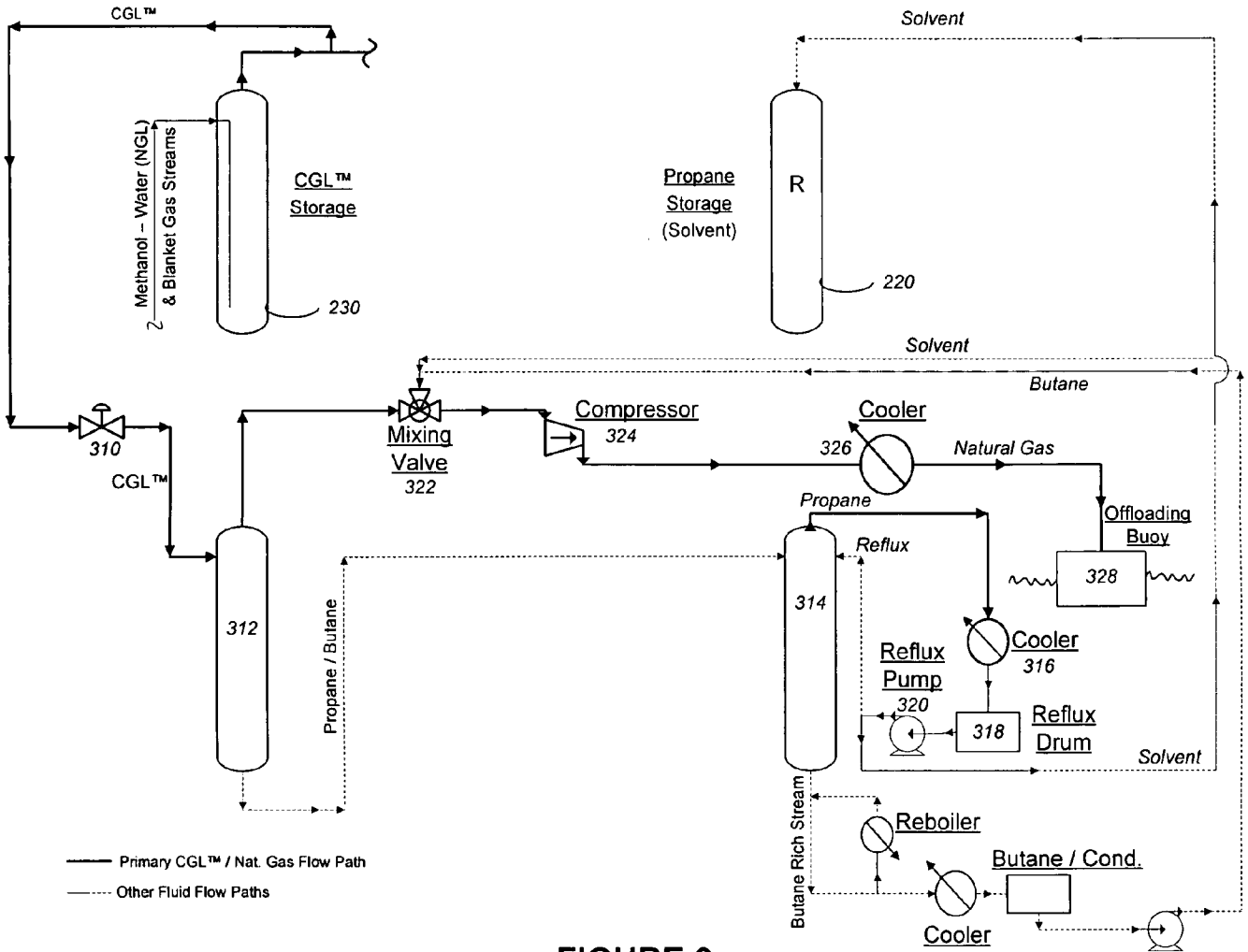
FIG. 3 is a process diagram that depicts the off-loading process of the present invention.

An off loading process, where the CGL™ gas mixture is displaced from the pipes or vessel bundles and the produced or natural gas is segregated and off loaded to a market pipeline, is illustrated in FIGS. 2 and 3. The stored CGL™ gas mixture is displaced from the pipeline system 220 using a methanol-water mixture stored in a storage system 210. This methanol-water mixture is pumped via circulating pumps 240 through part of the process to obtain pipeline temperatures. As shown in Step 1 in FIG. 2, the cold methanol-water mixture displaces the CGL™ gas mixture from one or a group of pipe bundles 222, for example Bank 1, to the unloading facilities shown in FIG. 3. As shown in Step 2, as the methanol-water mixture looses pressure through the system 220, it returns to the circulating pumps 240 to increase its pressure. The higher pressure methanol-water mixture is then shuttled for use in the next group of pipe bundles 222, for example Bank 2. CGL™ displacement is achieved by reduction of pressure of the displaced fluid passing through a pressure reduction valve 310 (FIG. 3).

As shown in Step 2, the methanol-water mixture in turn is reduced in pressure and is displaced from the pipeline system 220 using an inert (blanket) gas such as nitrogen. As shown in Step 3, the methanol-water mixture is purged from the pipe bundles 222 and the blanket gas remains in the pipe bundles 222 for the return voyage.

Turning to FIG. 3, in accordance with the off loading process 300, which includes separation and fractionation processes, the displaced CGL™ gas mixture flows from the pipeline system 230 to a pressure control station 310, preferably a Joule Thompson Valve, where it is reduced in pressure. A two phase mixture of light hydrocarbons flows to the de-ethanizer 312 whereupon an overhead stream consisting predominately of methane and ethane is separated from the heavier components, namely, propane, butanes and other heavier components.

The heavier liquid stream exiting the bottom of the de-ethanizer 312 flows to a de-propanizer 314. The de-propanizer 314 separates the propane fraction from the butane and heavier hydrocarbon fraction. The propane fraction flows overhead and is condensed in a cooler 316 and fed into a reflux drum 318. Part of the condensed stream is fed back from the reflux drum 318 to the de-propanizer 314 column as reflux and the balance of the propane stream flows to the pipeline system as solvent and is stored in the solvent storage system 220 for reuse with the next batch of natural or produced gas to be stored and transported. As shown in Step 3 of FIG. 2, reserve shuttle batches of NGL solvent and methanol-water mix remain in separate groups of pipe bundles for use with the next load of natural or produced gas to be stored and transported.

The methane-ethane flow of gas from the de-ethanizer 312 is passed through a series of heat exchangers (not shown) where the temperature of the gas stream is raised. The pressure of the methane/ethane flow of gas is then raised by passing the gas through a compressor 324 (if necessary) and the discharge temperature of the methane/ethane flow of gas is then reduced by flowing through a cooler 326.

The butane rich stream leaving the bottom of the de-propanizer 314 passes through a cooler 332 where it is cooled to ambient conditions and then flows to a condensate storage tank(s) 334.

A side stream of the butane rich stream passes through a reboiler 330 and then back into the butane rich stream. The butane condensate mixture is then pumped via a pump 336 to the mixing valve 322 and is joined with a side stream of solvent for BTU adjustment and finally mixes with the methane—ethane stream. The gross heat content of the gas mix can preferably be adjusted to a range between 950 and 1260 BTU per 1000 cubic feet of gas.

The offloaded gas is ready to meet delivery conditions for offloading to a receiving flexible pipeline which may be connected to a buoy 328. The buoy 328 is in turn connected to a mainland delivery pipeline and storage facilities.

In the foregoing specification, the invention has been described with reference to specific embodiments thereof. It will, however, be evident that various modifications may be made thereto without departing from the spirit and scope of the invention. Features and processes known to those skilled in the art may be added or subtracted as desired. Accordingly the invention is not to be restricted except in the light of the attached claims and their equivalents.

What is claimed is:

1. An integrated system for bulk storage and transport of gas comprising a loading and mixing system adapted to mix a gas with a liquid solvent to form a gas-solvent mixture in a liquid medium form, a containment system adapted to store the gas-solvent mixture at storage pressures and temperatures associated with storage densities for the gas-solvent mixture that exceeds the storage densities of CNG for the same storage pressures and temperatures, and a separation, fractionation and offloading system for separating the gas from the gas-solvent mixture.

2. The system of claim 1 wherein the loading and mixing system, containment system, and separation, fractionation and offloading system are installed on a transport vessel.

3. The system of claim 2 wherein the transport vessel is a marine based transport vessel.

4. The system of claim 2 wherein the transport vessel is a land based transport vessel.

5. The system of claim 1 wherein the containment system comprises a looped pipeline containment system with recirculation facilities to maintain temperature and pressure.

6. The system of claim 5 wherein the looped pipeline system comprises a horizontally nested pipe system.

7. The system of claim 6 wherein the horizontally nested pipe system is configured for serpentine fluid flow pattern between adjacent pipes.

8. The system of claim 5 wherein the looped pipeline system comprises a vertically nested pipe system equipped with vertical dip tubes for an integrated filling, displacement, and circulating function.

9. The system of claim 8 wherein the vertically nested pipe system includes top or bottom side mounted hardware.

10. The system of claim 5 wherein the looped pipeline system includes vent and fitting free pipe bases.

11. The system of claim 1 further comprising a dehydration means to dehydrate the gas prior to storage.

12. The system of claim 11 wherein the offloading system includes a displacement means for displacing the gas-solvent mixture from the containment system.

13. The system of claim 12 wherein the dehydration and displacement means include the use of methanol-water mixture as a dehydration fluid and a displacement fluid.

14. The system of claim 13 wherein the displacement means further comprises a means for purging of the displacement fluid using an inert gas.

15. The system of claim 1 wherein the offloading system comprises a means for adjusting a gross heat content of an offloaded gas.

16. The system of claim 15 wherein the gross heat content is adjustable to within a range of about 950 to 1260 BTU per 1000 $ft^3$ of gas.

17. A method comprising the steps of loading a gas to be transported onto a transport vessel, mixing the gas with a liquid solvent to form a gas-solvent mixture in a liquid medium form, dehydrating the gas, storing the gas-solvent mixture for transport in a looped pipeline system, recirculating the stored gas-solvent mixture to maintain a predetermined temperature and pressure, separating the gas from the gas-solvent mixture, and off-loading the gas from the transport vessel.

18. The method of claim 17 further comprising the step of shuttling a displacement fluid between pipes of the pipeline system to displace the gas-solvent from the pipeline system to separate and off-load the gas.

19. The method of claim 17 wherein the step of storing includes storing the gas-solvent mixture at temperatures in a range of about −20° F. to about −180° F. and pressures in a range of about 1100 psig to about 2150 psig.

20. The method of claim 17 further comprising the step of adjusting a gross heat content of the offloaded gas.

21. The method of claim 20 wherein the gross heat content is adjustable to within a range of about 950 to 1260 BTU per 1000 $ft^3$ of gas.

* * * * *

UNITED STATES PATENT AND TRADEMARK OFFICE

CERTIFICATE OF CORRECTION

PATENT NO. : 7,517,391 B2
APPLICATION NO. : 11/483137
DATED : April 14, 2009
INVENTOR(S) : Bruce Hall, Michael J. Mulvany and Tolulope O. Okikiolu It is certified that error appears in the above-identified patent and that said Letters Patent is hereby corrected as shown below:

On the Title Page Item (75), please change “Micahel” to read --Michael--.

Signed and Sealed this

Twenty-eighth Day of July, 2009

John Doll

JOHN DOLL
*Acting Director of the United States Patent and Trademark Office*